United States Patent [19]

Braid

[11] 4,330,421

[45] May 18, 1982

[54] SULFURIZED PHENOL DERIVATIVES AND COMPOSITIONS THEREOF

[75] Inventor: Milton Braid, Westmont, N.J.

[73] Assignee: Mobil Oil Corporation, New York, N.Y.

[21] Appl. No.: 167,612

[22] Filed: Jul. 11, 1980

[51] Int. Cl.[3] ..... C10M 1/54

[52] U.S. Cl. ..... 252/42.7; 252/389 R; 252/400 R; 260/439 R

[58] Field of Search ..... 252/42.7, 389 R, 400 R; 260/439 R

[56] References Cited

U.S. PATENT DOCUMENTS

| | | | |
|---|---|---|---|
| 2,362,293 | 11/1944 | McNab et al. | 252/42.7 X |
| 2,406,041 | 8/1946 | Schneider et al. | 252/42.7 |
| 2,409,687 | 10/1946 | Rogers et al. | 252/42.7 X |
| 2,518,379 | 8/1950 | Rogers et al. | 252/42.7 X |
| 2,716,090 | 8/1955 | Hakala et al. | 252/42.7 |
| 2,913,412 | 11/1959 | Moore et al. | 252/42.7 |
| 3,490,737 | 1/1970 | Geseking et al. | 252/42.7 |
| 4,198,303 | 4/1980 | Braid | 252/42.7 |
| 4,211,663 | 7/1980 | Braid | 252/42.7 |
| 4,226,733 | 10/1980 | Armstrong et al. | 252/42.7 |

*Primary Examiner*—Andrew Metz

*Attorney, Agent, or Firm*—Charles A. Huggett; Michael G. Gilman; James D. Tierney

[57] ABSTRACT

Lubricant compositions containing minor effective amounts of calcium phenol sulfides containing controlled amounts of a transition metal wherein the transition metal is derived by a direct exchange reaction for calcium provide stabilizer/detergent properties thereto and protect the compositions thereof against oxidative deterioration.

8 Claims, No Drawings

DESCRIPTION OF SPECIFIC EMBODIMENTS

EXAMPLE 1

An oil diluted commercial overbased calcium alkylated phenol sulfide typically having a calcium content of 5.25% and a total base number of about 140–150. This commercial calcium phenate may be manufactured as disclosed in the patent literature by reaction of an alkylated phenol in diluent oil solution with a basic calcium reactant in the presence of a catalyst or promoter and thereafter carbonated to the final degree of overbasing. The alkylated phenols usually contain from 4–32 carbon atoms total or 4–16 carbon atoms in any one side chain.

EXAMPLE 2

A commercial neutral alkylated phenol sulfide typically having a calcium content of about 3.5% and a total base number of about 100 and consisting of approximately fifty percent by weight of diluent oil. This commercial calcium phenate may be manufactured by reaction of an alkylated phenol with sulfur chloride followed by conversion of the resulting phenol sulfide to the calcium derivative by subsequent reaction with basic calcium reagents directly or preceded by initial reaction with alkali metal bases.

EXAMPLE 3

Separation of Diluent Oil from Overbased Calcium Phenol Sulfide

To an aliquot of commercial oil diluted overbased (total base number, 140) calcium phenol sulfide described in Example 1 (29.4 g) stirred magnetically there was added rapidly at room temperature, 2-propanol (400 ml) which caused the precipitation of solids. After several hours of stirring the precipitated solids were collected and air dried to give 7.2 g which gave the following elemental analysis: C, 55.10%; H, 7.53%; S, 6.70%; Ca, 10.3%.

Additional treatment with 2-propanol (300 ml) afforded a second fraction of 6.9 g of solids with the following elemental analysis: C, 55.29%; H, 7.69%; S, 6.50%; Ca, 9.9%.

Removal of the 2-propanol from the liquid residue left mainly the diluent oil which the infrared spectrum showed to contain phenol and/or phenol sulfide which had not been converted to calcium derivatives in the original processing.

EXAMPLE 4

Nickel Exchanged Overbased Calcium Phenol Sulfide-Effect of Prolonged Reaction Time at Higher Temperature in The Presence of Nickel Sulfate To a clear solution of the commercial overbased (total base number, 140) calcium thiobis(alkylphenate) of Example 1, an approximately 57% concentrate in diluent oil (183.9 g) in xylene (500 ml) there was added a solution of nickel sulfate hexahydrate (52.5 g) in water while stirring at room temperature. The resulting reaction mixture was heterogeneous but free of solids. Denatured ethanol (50 ml) was added and after a few minutes the temperature was raised to 35° C. for 0.5 hr. and then to 80°–90° C. as precipitating solids caused substantial thickening. Additional xylene (200 ml) was added as water was removed by azeotropic distillation during a total 5 hr. reaction period as the temperature rose to 140° C. The resulting mixture was filtered hot and the filtrate was stripped of solvent xylene under reduced pressure. The oil concentrate of the nickel-exchanged product was obtained as a greenish dark brown moderately viscous liquid with the following elemental analysis: S, 3.39%; Ca, 0.51%; Ni, 3.72%.

EXAMPLE 5

Nickel Exchanged Overbased Calcium Phenol Sulfide 2-Propanol/Methanol (All Alcohol) Solvent System To a mixture of the overbased calcium phenol sulfide of Example 1 (150 g) and isopropyl alcohol (400 ml) there was added while stirring over a period of one hour a solution of nickel sulfate hexahydrate (53 g) in methanol (150 ml). During the addition the temperature was raised from 45° to 70° C. An additional quantity of isopropyl alcohol (400 ml) was added to disperse balled solids which ogglomerated during the addition and the mixture was refluxed for six hours. From this reaction there was obtained the oil diluted nickel exchange product as a greenish brown viscous oil with the following elemental analysis: S, 2.20%; Ni, 1.36%; Ca, 0.57%.

EXAMPLE 6

Nickel Exchanged Overbased Calcium Phenol Sulfide (Hexane/Water Solvent System)

To a solution of the commercial overbased alkylated phenol sulfide of Example 1 (183.9 g) in n-heptane (750 ml) there was rapidly added a solution of nickel sulfate hexahydrate (52.5 g) in water (150 ml). The reaction mixture was stirred and heated at reflux until 50 ml of water had been removed. There was only a minor amount of insoluble solids observable in the mixture. To the reaction mixture ethanol (50 ml) was added rapidly which resulted in precipitation of solids and increasing turbidity during a total time of 3.5 hr. At the end of this time the precipitated solids had coagulated mainly in the aqueous phase. The reaction mixture was stripped of solvents and water under reduced pressure. Filtration of the distillation residue afforded the product as a viscous dark amber oil with the following elemental analysis: S, 3.10%; Ni, 3.27%; Ca, 0.98%.

EXAMPLE 7

Nickel Exchanged Overbased Calcium Phenol Sulfide (Petroleum Ether/Methanol-Ethanol Solvent System)

To a solution of the oil diluted commercial overbased (total base number, 140) calcium phenol sulfide of Example 1 (183.9 g) in petroleum ether (500 ml) there was rapidly added while stirring at room temperature a solution of nickel sulfate hexahydrate in a mixture of methanol-ethanol (200 ml). In less than 0.25 hr. thickening of the reaction mixture by precipitation required dilution by additional petroleum ether (400 ml). The reaction mixture was heated to reflux for more than 1 hr. and then filtered to remove solids. The filtrate was stripped of solvents by reduced pressure distillation, re-extracted with petroleum ether, and refiltered. The filtrate was solvent stripped leaving the nickel exchanged calcium phenol sulfide obtained as a dark brown viscous oil solution with a greenish cast and the following elemental analysis: S, 2.84%; Ni, 4.58%; Ca, 1.5%.

EXAMPLE 8

Iron Exchanged Overbased Calcium Phenol Sulfide

To a clear solution of commercial oil diluted overbased (total base number, 140 as supplied) calcium phe-

SULFURIZED PHENOL DERIVATIVES AND COMPOSITIONS THEREOF

BACKGROUND OF THE INVENTION

1. Field of the Invention

This invention is directed to lubricant additives comprising transition metal-containing calcium derivatives of phenol sulfides, and lubricant compositions thereof. Such additives impart stabilizer and detergent properties to lubricant compositions containing same and are accordingly highly effective in various hydrocarbyl lubricants and fluids. Formulations containing said additives are provided for prolonged usefulness and improved effectiveness for their intended purpose.

2. Discussion of the Prior Art

There is an extensive and well known background in the patent literature dealing with calcium phenates, a term which is recognized as the designation for neutral and overbased calcium derivatives of phenol sulfides, disulfides and oligomers thereof. The patent literature also contains disclosures of related derivatives of other metals including transition metals. See, for example, U.S. Pat. Nos. 2,362,293 and 2,409,687. However, the transition metal prior art compositions disclosed are not the same as or similar to the compositions of this instant invention nor do the disclosures of the prior art anticipate or suggest the compositions of the present invention. The prior art compositions resulted from either the sole use of transition metal bases to make transition metal derivatives exclusively or from the random introduction of transition metals into calcium phenates by use of mixtures of calcium and transition metal bases rather than the controlled specific replacement of calcium by a transition metal in accordance with the additives of this invention. The compositions of this invention contain both transition metals and calcium in selective arrangements. The compositions in accordance herewith are therefore believed to be novel and outside the scope of previous disclosures, patent or otherwise.

SUMMARY OF THE INVENTION

This invention is therefore directed to novel lubricant compositions comprising a minor stabilizer and/or detergent amount of novel transition metal-containing calcium derivatives of phenol sulfides and a major amount of a fluid hydrocarbyl medium selected from functional fluids, oils of lubricating viscosity or greases or other solid lubricants prepared therefrom. The various functional fluids that this invention are concerned with include hydraulic and circulating fluids, transmission fluids, power steering fluids and brake fluids.

The neutral and overbased calcium phenate derivatives of alkylated phenol sulfides which comprise the reactants for the additive materials described herein may be prepared in any convenient manner known or suggested in the prior art. However, the reactants are then preferably converted in a direct exchange process wherein calcium from calcium derivatives of phenol sulfides is selectively exchanged for a transition metal to provide the additives of the present invention. The proportion of calcium can be varied and the compounds thus produced can contain both calcium and a transition metal in a controlled and varied ratio. Thus the degree of replacement can be total or partial depending upon specific reagents, reactant ratios and reaction conditions. Partial replacement of calcium by transition metal is preferred in order to achieve the optimum balance of stabilizer and detergent properties.

The exchange reaction is effected by reaction of the neutral or overbased calcium phenate with a solution of the sulfate salt of the transition metal in an appropriate solvent system. The calcium phenate may be reacted as a solution in diluent oil or it may be free of oil and reacted in solvents such as benzene, hexane, petroleum ether, isopropyl alcohol as mixtures of these and similar solvents. The transition metal sulfates as hydrates may be reacted in aqueous solution or in alcohol solvents such as methanol, ethanol, isopropyl alcohol and the like. When the reaction system is heterogeneous for example as in the reaction of an oil diluted calcium phenol sulfide with an aqueous solution of nickel sulfate an interphase reaction promoter such as ethanol or isopropyl alcohol in minor amounts can be used to expedite the reaction.

The calcium atoms in the calcium phenol sulfide are not equivalent in ease or rate of direct exchange and this is the basis for controlling the selectivity and extent of exchange. Reactant ratios, choice of solvent systems, length of reaction period, and temperature can be used severally and jointly in effecting the exchange to achieve the desired balance of stabilizer/detergent properties. While it is not the sole controlling factor in determining the properties of the additives in this invention the ratios of calcium to transition metal in terms of weight percent is useful in judging the stabilizer effectiveness and the preferred ranges vary from about 0.2 to about 80 and the most preferred range is from about 1.5 to about 10. The resultant calcium/transition metal compounds contain at least about 0.01 to 10 wt.% of transition metal and preferably from about 0.025 to 2.5 wt.% based on the weight of the total composition.

The additive compounds so prepared which do contain calcium may also retain varying amounts of coordinated calcium in the form of calcium carbonate.

The reactant phenol sulfide calcium derivatives are well known as detergents in lubricating formulations to which they also contribute some oxidative stabilizing effect. Introduction of transition metals by direct selective exchange with calcium into these calcium phenates results in a surprisingly large degree of oxidation protection which is unexpectedly imparted by this novel class of additives to lubricants and various functional fluids.

The additive compounds are highly useful in mineral oils, mineral oil fractions, synthetic oils and in mixtures of mineral and synthetic oils in providing increased resistance to degradation and deterioration resulting from oxidation. The synthetic oils or fluids include synthetic hydrocarbon oils derived from long chain alkanes or olefin polymers, ester oils obtained from polyhydric alcohols and monocarboxylic acids or monohydric alcohols and polycarboxylic acids.

The additive compounds in accordance with this invention may be effectively used in concentrations of from about 0.01 to about 5 wt. % based on the total weight of the composition. Preferred are concentrations of from about 0.25 to about 5 wt. %. Other additives may be effectively used in the compositions hereof for their intended purposes.

The following material is exemplary and is not intended in any way to limit the invention.

nol sulfide (183.9 g), as per Example 1, in xylene (500 ml) and denatured ethanol (50 ml) there was added while stirring at 40° C. a solution of ferrous sulfate heptahydrate (55.5 g) in water (60 ml). Solids precipitated as the temperature was raised during 0.25 hr. to 82° C. and held for 2.25 hr. while the mixture became increasingly turbid. The temperature was again raised to remove alcohol and water by azeotropic distillation recycling the xylene. The resulting dried reaction mixture was filtered hot through filter aid and the solvent was stripped from the filtrate under reduced pressure. The iron exchanged product was obtained as a brown oil (171 g) which had the following elemental analysis: S, 3.40%; Fe, 3.2%; Ca, 0.39%.

EXAMPLE 9

Cobalt Exchanged Overbased Calcium Phenol Sulfide

To a solids free reaction mixture consisting of commercial overbased (total base number, 140 as an oil diluted concentrate) calcium phenol sulfide (183.9 g) as described in Example 1 in xylene (500 ml) and cobalt II sulfate hexahydrate (52.5 g) in water (150 ml) there was added rapidly while stirring at room temperature denatured ethanol (50 ml). After nearly 0.25 hr. solids began to precipitate. The temperature was raised to 90° C. during about 0.5 hr. and then raised further during about 4 hr. to 135° C. while alcohol and water were removed by azeotroping. Solids were removed by filtration, and the filtrate was stripped of solvent by rotary film evaporation under reduced pressure. The cobalt exchanged calcium phenol sulfide was obtained as a very dark moderately viscous oil concentrate with the following elemental analysis: S, 3.4%; Co, 4.59%; Ca, 0.13%.

EXAMPLE 10

Nickel Exchanged Overbased Calcium Phenol Sulfide-Effect of Short Time at Low Temperature To a clear solution of the commercial overbased (total base number, 140) calcium thiobis (alkylphenate) of Example 1 comprising an approximately 57% concentrate in refined petroleum oil diluent (183.9 g) in n-heptane containing denatured ethanol (50 ml) there was added rapidly while stirring, a solution of nickel sulfate hexahydrate (52.5 g) in water (150 ml). Precipitation of solids which began almost at once during the addition continued during the subsequent 1.5 hr. reaction period at room temperature. The reaction mixture was washed with water to remove unreacted nickel sulfate and the solids-containing organic layer was taken up in xylene. The xylene mixture was azeotroped to remove all water and then filtered to remove the calcium salt solids. The filtrate was distilled to remove n-heptane and xylene solvents leaving the nickel exchanged product as a greenish dark brown moderately viscous oil concentrate which gave the following elemental analysis: S, 3.58%; Ca, 1.23%; Ni, 3.23%.

EXAMPLE 11

Nickel Exchanged Oil Free Overbased Calcium Phenol Sulfide

To a solution of oil free overbased calcium phenol sulfide (72 g) precipitated from a commercial overbased (total base number, 140 in the oil diluted commercial product) calcium phenol sulfde by the general method of Example 4 in benzene (560 ml) there was added a methanolic solution of nickel sulfate hexahydrate decanted from a solution-suspension of the metal salt (40 g) in methanol (350 ml). When about 75 vol. % of the solution had been added precipitation of solids in the reaction mixture began and increased rapidly. All of the remaining solution-suspension was then poured into the reaction mixture, stirring was continued at room temperature for 3 hr. and then the mixture was refluxed for about 2.5 hr. The azeotropic mixture of benzene and methanol was azeotropically distilled from the reaction mixture with replacement of the benzene until all of the methanol had been removed. The reaction mixture was filtered and centrifuged to remove solids and the filtrate was stripped of solvent in a rotary film evaporator under reduced pressure. The partially nickel exchanged product remained as a greenish brown solid with the following elemental analysis: C, 51.00%; H, 7.05%; S, 8.30%; Ni, 9.50%, Ca, 5.1%.

EXAMPLE 12

Nickel Exchanged Neutral Calcium Phenol Sulfide

To a solution of the oil diluted neutral calcium-phenol sulfide of Example 2 (1471 g) in isooctane (700 ml) heated and stirred at 40° C. was added ethanol (100 ml) and then nickel sulfate hexahydrate (255.4 g). A total of 150 ml of water was added to the reaction and the temperature was raised to 81° C. during 4 hr. of heating and stirring and thereafter maintaining the temperature at 80°-81° C. for an additional 3.5 hr. Water and alcohol were removed by reduced pressure distillation and final purging with a nitrogen stream at 135° C. at atmospheric pressure. Solids were removed by filtration through filter aid assisted by dilution with additional solvent. Solvent was removed fom the filtrate by rotary film evaporation under reduced pressure leaving the nickel exchanged calcium phenol sulfide oil concentrate as a dark moderately viscous liquid with the following elemental analysis: C, 79.09%; H, 10.98%; S, 1.67%; Ni, 1.16%; Ca, 0.46%.

EXAMPLE 13

Nickel Exchanged Neutral Calcium Phenol Sulfide—Non-Aqueous Solvent System

To a solution of the neutral calcium phenol sulfide of Example 2 (50 g) in methanol (150 ml) containing ethanol (50 ml) there was added during several minutes while stirring a solution of nickel sulfate hexahydrate (20 g) in methanol (100 ml) containing ethanol (25 ml). The reaction mixture was stirred with slight warming for about 0.5 hr. and then after standing overnight at room temperature was stripped of solvents under reduced pressure. The residue was extracted with petroleum ether and filtered to remove solids. The solids were extracted with water to recover unreacted nickel sulfate leaving some solids shown by X-ray diffraction to be almost entirely hydrated calcium sulfate.

Stripping of the petroleum ether from the organic filtrate under reduced pressure left the nickel exchanged calcium phenol sulfide as a brownish viscous liquid with the following elemental analysis: C, 77.11%; H, 10.70%; S, 1.8%; Ni, 2.64%; Ca, 0.03%.

EXAMPLE 14

Nickel Exchanged Overbased Calcium Phenol Sulfide—Effect of Lower Ratio of Nickel Reagent A mixture of commercial oil diluted overbased (total base number, 140 in the product as supplied) calcium phenol sulfide (183.9 g) as described in Example 1, xylene (500 ml), denatured ethanol (50 ml), nickel sulfate hexahydrate (20 g), and water (150 ml) was heated while stirring from 25° C. to 50° C. during 1.5 hr. as the turbidity increased. The temperature was then raised to about 81° C. as alcohol and water were removed by azeotropic distillation with recycling of the xylene during 5 hr. The reaction mixture was filtered hot through filter aid and the filtrate was solvent stripped by rotary film distillation under reduced pressure. The nickel exchanged product was obtained as a greenish brown moderately viscous oil solution with the following elemental analysis: S, 3.30%; Ni, 1.94%; Ca, 1.3%.

EXAMPLE 15

Nickel Exchanged Overbased Calcium Phenol Sulfide—Effect of 2-Propanol Solvent—Transphase Agent A commercial oil diluted overbased (total base number, 140) calcium phenol sulfide with the elemental analysis: S, 3.35%; Ca, 5.1% was stirred with excess nickel sulfate hexahydrate using 2-propanol as solvent and as the transphase solubilizing agent for the nickel reactant. The reaction mixture was freed of the 2-propanol solvent and water by distillation at a pot temperature of greater than 125° C. under reduced pressure and then filtered to afford the nickel exchanged product with the following elemental analysis: S, 3.5%; Ni, 3.78%; Ca, 0.27%.

The compounds thusly prepared were thereafter tested in the following manner:

The Catalytic Oxidation Test was used to evaluate the oxidative stabilization properties of the calcium-transition metal exchanged phenol sulfides. In this test the transition metal interchanged products were tested in a catalytic oxidation test in which the stabilizer agent in solution in a neutral solvent refined base oil having a viscosity at 100° F. of 130 SUS is subjected to heating at 325° F. in the presence of lead, iron, copper, and aluminum metal specimens for 40 hr. while air is passed through at a rate of 5 liters per hour. The extent of oxidative deterioration is assessed by the increase in acidity, change in the neutralization numbers (ΔNN) as measured by ASTM D-974 and by the observed increase in viscosity (percentage charge, %ΔKV).

The results in the Table clearly show the effectiveness of these additives in stabilizing oils of lubricating viscosity against oxidation, and differentiate strikingly the degree of effectiveness of these additives compared with the reactant calcium phenates.

TABLE

| Test Oil | Concentration of Additive, Wt. % | ΔNN | ΔKV, % |
|---|---|---|---|
| Base Oil, no additive | — | 17 | 334 |

TABLE-continued

| Test Oil | Concentration of Additive, Wt. % | ΔNN | ΔKV, % |
|---|---|---|---|
| Base Oil + additive of Example 1 | 1 | 12.4 | 224 |
| Base Oil + additive of Example 2 | 2 | 14.7 | 168 |
| Base Oil + additive of Example 3(1) | 1 | 5.8 | 53 |
| Base Oil + additive of Example 4 | 1 | 4 | 13 |
| Base Oil + additive of Example 5 | 1 | 7.5 | 39 |
| Base Oil + additive of Example 6 | 1 | 5.6 | 24 |
| Base Oil + additive of Example 7 | 1 | 10.3 | 73 |
| Base Oil + additive of Example 8 | 1 | 3.5 | 20 |
| Base Oil + additive of Example 9 | 1 | 6.8 | 52 |
| Base Oil + additive of Example 11(1) | 1 | 0.75 | 10 |
| Base Oil + additive of Example 12 | 2 | 6.0 | 24 |

(1)100% active; no diluent oil

In evaluating the results of this test, control of the viscosity increase is deemed the most important consideration since efficient functioning of operating mechanisms is dependent on maintaining the viscosity of lubricants for which they have been calibrated in design and engineering. Development of acidity is also important but excess acidity can often be dealt with in lubricant formulation by inclusion of acid neutralizing agents. Particular attention should, however, be given to comparing the test results of Example 1 with those of Examples 4, 5, 6, 7, 8 and 9 and of Example 2 with the results of Example 12 and those of Example 3 with the results of Example 11. The degree of improvement is immediately, obvious, most surprising and quite unexpected.

Deviations and variations from the exemplary material disclosed herein can be readily made within the scope of this disclosure as is well known to those of skill in the art.

I claim:

1. A lubricant composition comprising a major amount of a hydrocarbyl medium selected from the group consisting of oils of lubricating viscosity and greases thereof and a minor stabilizer/detergent amount of a neutral or overbased calcium/transition metal phenol sulfide wherein said calcium/transition metal phenol sulfide has at least about 0.01 to about 10 wt. %, based on the total weight of said metal phenol sulfide composition of said transition metal, said transition metal being derived from a direct exchange reaction of said transition metal with calcium phenol sulfide.

2. The composition of claim 1 wherein the concentration of the transition metal is from about 0.025 to 2.5 wt. %.

3. The composition of claim 1 wherein the transition metal is selected from cobalt, iron and nickel.

4. The composition of claim 3 wherein the transition metal is nickel.

5. The composition of claim 3 wherein the transition metal is cobalt.

6. The composition of claim 3 wherein the transition metal is iron.

7. The composition of claim 1 wherein the hydrocarbyl medium is an oil of lubricating viscosity selected from mineral oils, synthetic oils, and mixtures thereof.

8. The composition of claim 1 wherein the hydrocarbyl medium is a grease.

* * * * *